US010173084B2

(12) United States Patent
Feil et al.

(10) Patent No.: US 10,173,084 B2
(45) Date of Patent: Jan. 8, 2019

(54) GAS MASK

(75) Inventors: Dirk Feil, Lübeck (DE); Werner Lange, Bad Segeberg (DE); Christoph Schmidt, Stockelsdorf (DE); Achim Volmer, Lübeck (DE); Martin Weisgerber, Bonn (DE)

(73) Assignee: DRAEGER SAFETY AG & CO. KGAA, Luebeck (DE)

( * ) Notice: Subject to any disclaimer, the term of this patent is extended or adjusted under 35 U.S.C. 154(b) by 1301 days.

(21) Appl. No.: 13/492,048

(22) Filed: Jun. 8, 2012

(65) Prior Publication Data

US 2013/0263848 A1 Oct. 10, 2013

(30) Foreign Application Priority Data

Apr. 10, 2012 (DE) ..... 10 2012 007 139

(51) Int. Cl.
*A62B 18/02* (2006.01)
*A62B 18/08* (2006.01)

(52) U.S. Cl.
CPC ..... *A62B 18/02* (2013.01); *A62B 18/08* (2013.01)

(58) Field of Classification Search
CPC ..... A62B 18/00; A62B 818/003; A62B 18/02; A62B 18/025; A62B 18/04; A62B 18/045; A62B 18/06; A62B 18/08; A62B 18/082; A62B 18/084; A62B 18/086; A62B 18/088; A62B 18/10
USPC ..... 128/200.24, 201.19, 201.22–202.11, 128/202.22, 205.24, 205.25, 205.27, 128/205.29, 206.12, 206.16, 206.17; 181/18, 20–22, 126, 127, 157–159, 175, 181/176, 177, 198, 204, 235; 367/132, 367/150; 381/337–339
See application file for complete search history.

(56) References Cited

U.S. PATENT DOCUMENTS

| | | | | |
|---|---|---|---|---|
| 1,762,695 A * | 6/1930 | Monro | A62B 18/08 128/201.15 |
| 2,077,313 A | 4/1937 | Dym | |
| 2,705,052 A | 3/1955 | Workinger | |
| 2,745,911 A * | 5/1956 | Webb | H04R 1/083 181/242 |
| 2,857,013 A * | 10/1958 | Orso | H04R 1/083 181/242 |
| 4,901,356 A * | 2/1990 | Bauer | 381/367 |
| D427,986 S * | 7/2000 | Webb | H04R 1/08 D14/154 |
| 6,365,084 B1 * | 4/2002 | Terajima | B29C 43/021 264/257 |
| 6,997,178 B1 * | 2/2006 | Reynaud | A62B 18/08 128/201.19 |

(Continued)

FOREIGN PATENT DOCUMENTS

DE 699 19 907 T2 9/2005

*Primary Examiner* — Gregory Anderson
*Assistant Examiner* — Elliot S Ruddie
(74) *Attorney, Agent, or Firm* — McGlew and Tuttle, P.C.

(57) ABSTRACT

A gas mask is provided with a mask body, which is designed to cover the face of a user, and with an opening in the mask body, which is closed by a speech diaphragm (8) in a gas-tight manner. A funnel (4) is directed toward the speech diaphragm with an opening angle in the range of 20° to 90°. The funnel (4) is arranged in front of the speech diaphragm in the interior space of the mask body in order to focus sound waves onto the speech diaphragm.

22 Claims, 3 Drawing Sheets

(56) References Cited

U.S. PATENT DOCUMENTS

| | | | | |
|---|---|---|---|---|
| 7,349,551 | B2 * | 3/2008 | Skillicorn et al. | 381/384 |
| 2009/0107504 | A1 * | 4/2009 | McAuley | A61M 16/06 128/205.25 |
| 2011/0159758 | A1 * | 6/2011 | Martin | B32B 3/266 442/1 |

* cited by examiner

GAS MASK

CROSS REFERENCE TO RELATED APPLICATIONS

This application claims the benefit of priority under 35 U.S.C. § 119 of German Patent Application DE 10 2012 007 139.6 filed Apr. 10, 2012, the entire contents of which are incorporated herein by reference.

FIELD OF THE INVENTION

The present invention pertains to a gas mask, with a mask body, which is designed to cover the face of a user, and with an opening in the mask body, which is closed gas-tightly by a speech diaphragm.

BACKGROUND OF THE INVENTION

Gas masks are used as personal protection gear to protect the user from inhalable toxic substances and toxic environmental substances. The field of use lies in occupational safety and especially in firefighting. Half masks or full masks are used for this, which supply the user with filtered ambient air or clean air from compressed air cylinders.

The masks protect the user especially well against environmental effects by sealing the face, especially the mouth and nose, against the environment with the mask body. This means, however, on the other hand, that speech is transmitted from the sealed mask to the outside space only poorly, because the materials greatly muffle speech. Verbal communication between gas mask users is therefore problematic.

Speech diaphragms, which are said to improve transmission of the user's speech through the mask to the outside, are frequently integrated in prior-art gas masks. The speech diaphragm consists of a thin plastic film or metal foil, which is fastened gas-tightly in an opening of the mask body. The speech diaphragm is stimulated by the sound in the interior of the mask and vibrates correspondingly, as a result of which it transmits corresponding sound waves itself to the outside. While the prior-art solutions are well suited for low-frequency sound components, the transmission of frequencies above 1 kHz is limited. The transmission function of the speech diaphragm is consequently frequency-dependent and decreases with rising frequency. This leads to distortions and compromises the intelligibility of speech, because the components with high frequencies are especially important for the intelligibility of speech.

An oxygen inhalation mask is known from DE 699 19 907 T2. A horn or a funnel is arranged in front of the user's mouth in the interior space of this mask. A microphone capsule is arranged in the smaller opening of the funnel pointing towards the user's mouth. The funnel is said to bring about focusing of the sound waves towards the microphone capsule.

SUMMARY OF THE INVENTION

The object of the present invention is to design a gas mask with speech diaphragm such that the intelligibility of the speech transmitted through the speech diaphragm is improved.

According to the invention, a gas mask is provided comprising a mask body which is designed to cover the face of a user. The mask body has an opening. A speech diaphragm is provided closing the opening in the mask body in a gas-tight manner. A funnel is directed towards the speech diaphragm with an opening angle in the range between 20° and 90°. The funnel is arranged in front of the speech diaphragm in an interior space of the mask body in order to focus sound waves onto the speech diaphragm.

A funnel (funnel part) is arranged according to the present invention in the interior of the mask hood such that the speech diaphragm is located in the opening of the funnel pointing towards the outside. The funnel opening angle is advantageously in the range of 20° to 90°. It was surprisingly found that such a funnel-shaped design considerably improves the intelligibility of speech, because especially sound waves of a higher frequency are transmitted to the speech diaphragm and are emitted by same better. Smaller opening angles do not generate sufficient amplification of the signal, because only a segment of the sound field extending in parallel is transmitted without convergence of outer parts. Larger opening angles likewise fail to have an amplifying effect any longer, because mainly reflection of the sound waves will now occur and thus these are not sent to the transmitting diaphragm at all. The opening angle of the funnel is defined as an opening angle of two diametrically opposed tangents to the inner wall of the funnel, namely a tangent to the inner wall at one side and a tangent to the inner wall at an opposite side. In exemplary embodiments in which the slopes of the tangents to the inner walls are no longer constant in the axial direction, but the funnel widens increasingly rapidly in the axial direction, the opening angle is defined as the opening angle of the mean tangent slopes of two diametrically opposed straight lines at the inner walls of the funnel.

The opening angle of the funnel is optimized for the amplification function of higher frequency ranges, especially between 800 Hz and 4.5 kHz and is between 20° and 90° and preferably between 30° and 50°.

The size of the funnel opening facing the speech diaphragm is preferably equal to the size of the speech diaphragm, i.e., the speech diaphragm fully covers the opening of the funnel without extending beyond the contour of the opening.

In a preferred embodiment, the funnel is connected at its opening facing the speech diaphragm to a frame, in which the speech diaphragm is held in a tensioned state. The frame may be made integrally in one piece with the funnel.

A protective grid is preferably arranged in front of the speech diaphragm in the funnel opening facing the speech diaphragm. The protective grid may have, for example, a plurality of ring elements, which are located concentrically in the opening facing the speech diaphragm and are held by a plurality of web elements extending radially in the opening facing the speech diaphragm. As an alternative, the protective grid may be formed by a plurality of web elements, which divide the speech diaphragm opening of the funnel into a plurality of honeycombed openings. The protective grid preferably has a regular grid with honeycombed openings of equal size, which is in the range of 10 $mm^2$ to 100 $mm^2$.

The material of the funnel is preferably soft enough, on the one hand, to guarantee sufficient wearing comfort for the user, and is, on the other hand, sufficiently reverberant to bring about the weakest possible dissipative, i.e., sound-muffling wall effects. The funnel is made for this purpose of a plastic material with a Shore A hardness of 30 to 80 in a preferred embodiment. The hardness of the plastic material is preferably in the range of Shore A 45 to 65.

The funnel does not have to be truncated cone-shaped, and the slope of the funnel wall may rather vary in the axial direction of the funnel, i.e., the slope of a tangent to the funnel wall may decrease in the axial direction from the end of the funnel facing away from the speech diaphragm to the end of the funnel facing the speech diaphragm. In addition, the funnel also does not have to be exactly rotationally symmetrical in relation to its longitudinal axis. The opening angle of such a funnel would then be determined in both of the above-mentioned cases as the mean opening angle.

The present invention will be explained below on the basis of exemplary embodiments shown in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
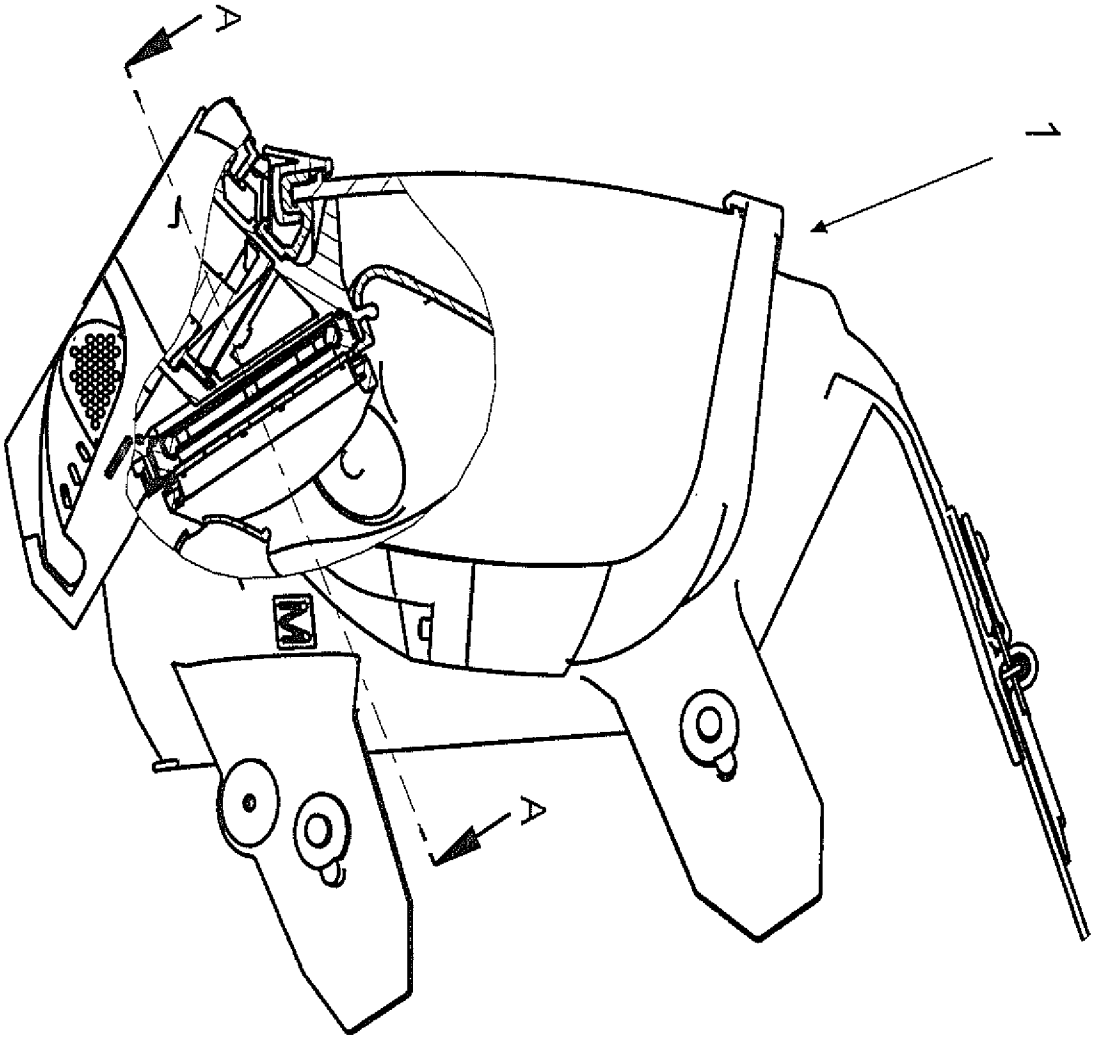
FIG. 1A is a side partially sectional view of a gas mask.
Figure 1B:
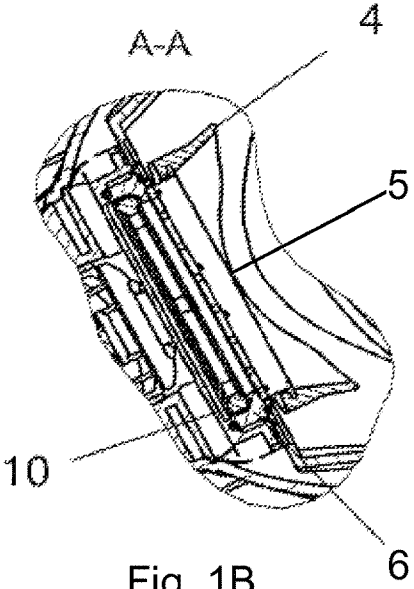
FIG. 1B is a sectional view taken along line A-A of FIG. 1A of the gas mask in the area of the speech diaphragm.
Figure 2:
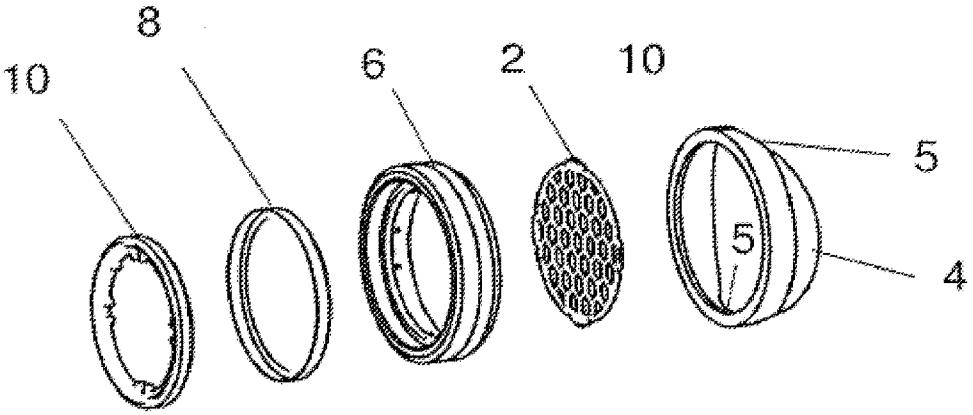
FIG. 2 is a perspective exploded view of the speech diaphragm and components surrounding same.
Figure 3:
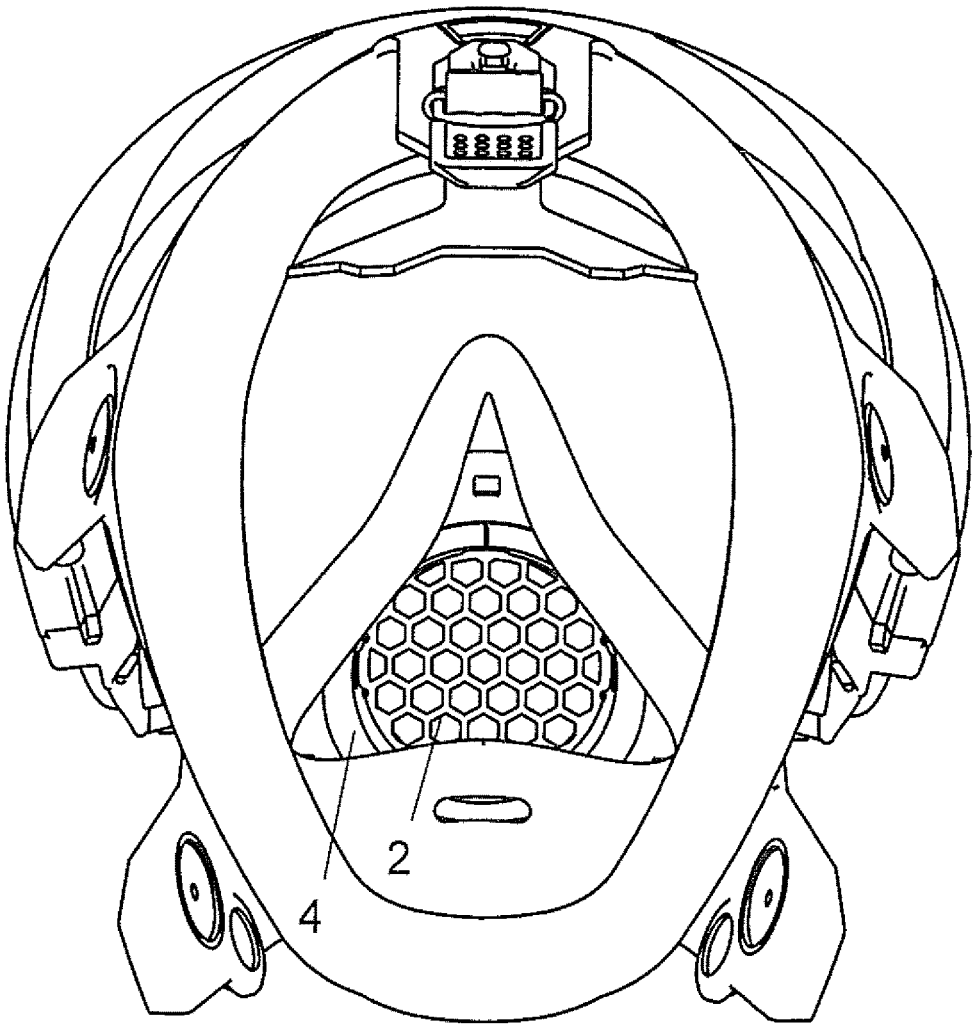
FIG. 3 shows a top view of the interior of the mask.

Referring to the drawings in particular, the design of the speech diaphragm unit will be described below with reference to FIGS. 1 and 2. Speech diaphragm 8 is enclosed by two threaded rings (a frame) 6 and 10, which hold the speech diaphragm 8 in the tensioned state. A protective grid 2, which covers the speech diaphragm 8 in the interior, joins in the interior of the gas mask.

The threaded ring 6 is joined in the interior of the mask by a funnel 4. In the embodiment shown, funnel 4 is not rotationally symmetrical, but the height is reduced in the axial direction in two opposite areas 5, as a result of which a free space is created for the mouth and nose of the user.

The funnel 4 or funnel part 4 has a funnel opening end defining an funnel opening. The funnel part 4 has a wall extending from the funnel opening end and to a funnel interior end. A spacing between the interior surface of the wall at opposite sides widens in the direction away from the funnel opening and towards an interior end and towards the interior of the mask. This widening, opening angle or wall angle is in a range between 20° and 90° (see FIG. 1B). The funnel part 4 is arranged adjacent to the speech diaphragm 8. The wall of the funnel part 4 extends into the user interior space of the mask body of mask 1 to focus sound waves onto said speech diaphragm 8.

The widening, opening angle or wall angle of funnel 4 is defined as an angle between diametrically opposite tangents to the inner wall of the funnel. This opening angle is in the range of 20° to 90° and preferably in the range of 30° to 50°. In the situation of embodiments in which the slopes of the tangents to the inner walls are no longer constant in the axial direction, but the funnel widens increasingly rapidly in the axial direction, the opening angle is defined as the opening angle of the mean tangent slopes of two diametrically opposed straight lines at the inner walls of the funnel.

The funnel 4 preferably consists of a plastic material with a Shore A hardness of 30 to 80 and preferably Shore A 45 to 65.

The protective grid 2 preferably defines, in a regular pattern, honeycombed openings, which are preferably in a size range of 10 $mm^2$ to 100 $mm^2$. The protective grid 2 is formed by a plurality of web elements, which divide the funnel opening facing the speech diaphragm into the plurality of honeycombed openings. The protective grid 2 may have a plurality of ring elements, which are located concentrically in the opening facing the speech diaphragm and which are held by a plurality of radially extending web elements in the funnel opening facing the speech diaphragm.

In a preferred embodiment, the funnel is connected at its opening facing the speech diaphragm to a frame, in which the speech diaphragm is held in a tensioned state. The frame may be made integrally in one piece with the funnel 4. FIG. 2 shows the features of the frame in an exploded view wherein the two threaded rings 6 and 10, which hold the speech diaphragm 8 in the tensioned state and possibly also the protective grid 2 may be a one piece structure made integrally in one piece with the funnel.

While specific embodiments of the invention have been shown and described in detail to illustrate the application of the principles of the invention, it will be understood that the invention may be embodied otherwise without departing from such principles.

APPENDIX

List of Reference Numbers

1 Gas mask
2 Protective grid
4 Funnel
5 Funnel areas with reduced wall height
6 Threaded ring
8 Speech diaphragm
10 Threaded ring

What is claimed is:

1. A gas mask comprising:

a mask body, which is designed to cover the face of a user, and with an opening in the mask body;

a speech diaphragm closing said opening in the mask body in a gas-tight manner; and a funnel directed towards said speech diaphragm with an opening angle in a range between 20° and 90°, said funnel having a funnel opening at one end thereof, said speech diaphragm closing said funnel opening at said one end of said funnel, said funnel being arranged in front of said speech diaphragm in an interior space of the mask body in order to focus sound waves onto said speech diaphragm, wherein said funnel comprises an upper circumferential area and a lower circumferential area, said upper circumferential area and said lower circumferential area extending less from said speech diaphragm than laterally adjacent side portions, whereby each of said laterally adjacent side portions is located between said upper circumferential area and said lower circumferential area, said upper circumferential comprising a nose engaging surface configured for engaging a nose of the user and said lower circumferential axial comprising an adjacent mouth engaging surface configured for engaging an area adjacent to the mouth of the user.

2. A gas mask in accordance with claim 1, wherein said funnel opening faces said speech diaphragm, said diaphragm having a size equal to a size of said funnel opening to fully cover said funnel opening in a gas-tight manner without said diaphragm extending beyond a contour of said funnel opening, said speech diaphragm being arranged in said funnel opening, said opening angle of said funnel being between 30° and 50°, said funnel having a first end portion and a second end portion, said first end portion defining said funnel opening, said second end portion defining a second end portion opening, said funnel opening being in communication with said second end portion opening and said interior space of the mask body, wherein said funnel extends from a proximal end adjacent to said speech diaphragm wider towards distal ends of said upper circumferential area, said lower circumferential area and said laterally adjacent side portions.

3. A gas mask in accordance with claim 1, wherein said funnel is connected to a frame at or adjacent to said funnel opening facing the speech diaphragm, said frame holding said speech diaphragm in a tensioned manner, said speech diaphragm being arranged in said funnel opening.

4. A gas mask in accordance with claim 3, wherein said frame is made in one piece with said funnel.

5. A gas mask in accordance with claim 1, further comprising a protective grid, wherein:

said funnel opening faces the speech diaphragm; and said protective grid is arranged in said funnel opening.

6. A gas mask in accordance with claim 5, wherein said protective grid has a plurality of ring elements, which are located concentrically in the funnel opening facing said speech diaphragm and which are held by a plurality of radially extending web elements in the funnel opening facing said speech diaphragm.

7. A gas mask in accordance with claim 5, wherein said protective grid is formed by a plurality of web elements, which divide the funnel opening facing said speech diaphragm into a plurality of honeycombed openings.

8. A gas mask in accordance with claim 7, wherein all of said honeycombed openings have the same size, which is in the range of 10 $mm^2$ to 100 $mm^2$.

9. A gas mask in accordance with claim 1, wherein said funnel is made of a plastic material with a Shore A hardness of 30 to 80.

10. A gas mask in accordance with claim 9, wherein said funnel is made of a plastic material with a Shore A hardness of 45 to 65.

11. A gas mask in accordance with claim 1, wherein a diameter of said funnel increases in a direction of said interior space of the mask body, said first circumferential area comprising a first circumferential area proximal end and a first circumferential distal end, said first circumferential area proximal end and said first circumferential distal end defining a first circumferential area extent, said first circumferential distal end being located at a spaced location from said first circumferential area proximal end, said second circumferential area comprising a second circumferential area proximal end and a second circumferential distal end, said second circumferential area proximal end and said second circumferential distal end defining a second circumferential area extent, said second circumferential distal end being located at a spaced location from said second circumferential area proximal end, each of said laterally adjacent side portions comprising a laterally adjacent side portion proximal end and a laterally adjacent side portion distal end, said laterally adjacent side portion proximal end and said laterally adjacent side portion distal end defining a laterally adjacent side portion extent, said laterally adjacent side portion distal end being located at a spaced location from said laterally adjacent side portion proximal end, said laterally adjacent side portion extent being greater than said first circumferential area extent and said second circumferential area extent, said first circumferential area proximal end, said second circumferential area proximal end and said laterally adjacent side portion proximal ends defining said funnel opening, said speech diaphragm being arranged in said funnel opening.

12. A gas mask in accordance with claim 1, wherein said upper circumferential area, said lower circumferential area and said laterally adjacent side portions are integrally connected to each other to form a one-piece funnel and said one-piece funnel is adapted to surround a mouth area and a nose area of the user, said funnel opening defining a speech diaphragm opening, said speech diaphragm being arranged in said speech diaphragm opening.

13. A gas mask comprising:

a mask body having an exterior side and a user face engaging side providing a user interior space and having an opening passing through the mask body from the exterior side to the user face engaging side;

a speech diaphragm closing said opening in the mask body in a gas-tight manner; and a funnel part with a funnel opening end defining a funnel opening and a wall extending from said funnel opening end to a funnel interior end, a straight line mean tangent slope at an inner wall surface and a straight line mean tangent slope at a diametrically opposed inner wall surface forming a wall angle in a range between 20° and 90°, said funnel part being arranged adjacent to said speech diaphragm and said wall extending into said user interior space of the mask body to focus sound waves from said interior space onto said speech diaphragm, said speech diaphragm closing said funnel opening at said funnel opening end, said funnel part being arranged directly adjacent to a user nose area and a user mouth area, said funnel part comprising a first circumferential area, a second circumferential area and laterally adjacent side portions, said first circumferential area, said second circumferential area and said laterally adjacent side portions extending in a direction away from said speech diaphragm, each of said laterally adjacent side portions being arranged adjacent to said first circumferential area and said second circumferential area, wherein an extent of said first circumferential area from said speech diaphragm and an extent of said second circumferential area from said speech diaphragm is shorter than an extent of said laterally adjacent side portions from said speech diaphragm, one of said laterally adjacent side portions comprising said inner wall surface, another one of said laterally adjacent side portions comprising said diametrically opposed inner wall surface, wherein said first circumferential area comprises a nose engaging surface adapted to engage a nose area of a user and said second circumferential area comprises a mouth engaging surface adapted to engage a mouth area of the user.

14. A gas mask in accordance with claim 13, wherein said funnel opening faces said speech diaphragm and said diaphragm has a size equal to a size of said funnel opening to fully cover said funnel opening in a gas-tight manner without said speech diaphragm extending beyond a contour of said funnel opening, said wall angle of said funnel part being between 30° and 50°, wherein said wall is arranged directly in said interior space, said wall defining a funnel interior end opening, said funnel end opening being in communication with said funnel opening and said user interior space, said speech diaphragm being arranged in said funnel opening.

15. A gas mask in accordance with claim 13, further comprising a frame wherein said funnel part is connected to said frame at or adjacent to said funnel opening facing said speech diaphragm, said frame holding said speech diaphragm in a tensioned manner.

16. A gas mask in accordance with claim 15, wherein said frame is made in one piece with said funnel part.

17. A gas mask in accordance with claim 13, further comprising a protective grid, wherein:

said funnel opening faces said speech diaphragm; and said protective grid is arranged in said funnel opening.

18. A gas mask in accordance with claim 17, wherein said protective grid is formed by a plurality of web elements, which divide the funnel opening facing the speech diaphragm into a plurality of honeycombed openings.

19. A gas mask in accordance with claim 18, wherein all of said honeycombed openings have the same size, which is in the range of 10 $mm^2$ to 100 $mm^2$.

20. A gas mask in accordance with claim 13, wherein said funnel is made of a plastic material with a Shore A hardness of 30 to 80.

21. A gas mask in accordance with claim 13, wherein a diameter of said funnel part increases in a direction of said user interior space of the mask body, said first circumferential area comprising a first circumferential area proximal end and a first circumferential distal end, said first circumferential area proximal end and said first circumferential distal end defining a first circumferential area extent, said first circumferential distal end being located at a spaced location from said first circumferential area proximal end, said second circumferential area comprising a second circumferential area proximal end and a second circumferential distal end, said second circumferential area proximal end and said second circumferential distal end defining a second circumferential area extent, said second circumferential distal end being located at a spaced location from said second circumferential area proximal end, each of said laterally adjacent side portions comprising a laterally adjacent side portion proximal end and a laterally adjacent side portion distal end, said laterally adjacent side portion proximal end and said laterally adjacent side portion distal end defining a laterally adjacent side portion extent, said laterally adjacent side portion distal end being located at a spaced location from said laterally adjacent side portion proximal end, said laterally adjacent side portion extent being greater than said first circumferential area extent and said second circumferential area extent, said first circumferential area proximal end, said second circumferential area proximal end and said laterally adjacent side portion proximal ends defining a speech diaphragm opening, said speech diaphragm being arranged in said speech diaphragm opening.

22. A gas mask in accordance with claim 13, wherein said first circumferential area, said second circumferential area and said laterally adjacent side portions are integrally connected to each other to form a single-piece funnel and said single-piece funnel is adapted to surround said mouth area and said nose area of the user, at least a portion of said speech diaphragm being arranged in said funnel, wherein said funnel extends from a proximal end adjacent to said speech diaphragm wider towards distal ends of said upper circumferential area, said lower circumferential area and said laterally adjacent side portions.

* * * * *